US008297768B2

(12) United States Patent
Kara et al.

(10) Patent No.: US 8,297,768 B2
(45) Date of Patent: Oct. 30, 2012

(54) DISHWASHER WITH A LIGHTING DEVICE OF THE WASHING COMPARTMENT

(75) Inventors: Seyfettin Kara, Spenge (DE); Markus Thuelig, Beckum (DE)

(73) Assignee: Miele & Cie . KG, Guetersloh (DE)

( * ) Notice: Subject to any disclaimer, the term of this patent is extended or adjusted under 35 U.S.C. 154(b) by 322 days.

(21) Appl. No.: 12/722,649

(22) Filed: Mar. 12, 2010

(65) Prior Publication Data

US 2010/0225211 A1 Sep. 9, 2010

(30) Foreign Application Priority Data

Mar. 23, 2009 (DE) ..... 10 2009 014 023

(51) Int. Cl.
*B08B 3/00* (2006.01)
*A47L 15/00* (2006.01)

(52) U.S. Cl. ..... 362/91; 362/89; 134/113

(58) Field of Classification Search ..... 362/89, 362/91; 134/58 D, 113; 340/586.1; 74/502.6
See application file for complete search history.

(56) References Cited

U.S. PATENT DOCUMENTS

| | | | | |
|---|---|---|---|---|
| 2,656,451 | A * | 10/1953 | Rick | 362/91 |
| 3,619,592 | A | 11/1971 | Lamb | |
| 5,795,052 | A * | 8/1998 | Choi | 362/91 |
| 6,510,759 | B2 * | 1/2003 | Johnson | 74/502.4 |
| 6,904,764 | B2 * | 6/2005 | Bassi | 62/264 |
| 7,334,589 | B2 * | 2/2008 | Jordan et al. | 134/200 |
| 7,380,559 | B2 | 6/2008 | Son et al. | |
| 7,578,303 | B2 | 8/2009 | Daume et al. | |
| 7,651,232 | B2 | 1/2010 | Baumgartner et al. | |
| 7,699,064 | B2 | 4/2010 | Schlief et al. | |
| 2006/0283482 | A1 | 12/2006 | Berends et al. | |
| 2007/0090949 | A1 * | 4/2007 | Baumgartner | 340/545.6 |
| 2009/0044846 | A1 | 2/2009 | Rosenbauer et al. | |

FOREIGN PATENT DOCUMENTS

| | | | |
|---|---|---|---|
| DE | 10256171 | A1 | 6/2004 |
| DE | 102004023509 | A1 | 12/2005 |
| DE | 102005028449 | A1 | 12/2006 |
| EP | 1543761 | A2 | 6/2005 |
| EP | 1554970 | A1 | 7/2005 |
| WO | WO 2006042819 | A1 | 4/2006 |
| WO | WO 2008073049 | A1 | 6/2008 |

* cited by examiner

*Primary Examiner* — Peggy A. Neils
(74) *Attorney, Agent, or Firm* — Leydig, Voit & Mayer, Ltd.

(57) ABSTRACT

A dishwasher includes a cleaning compartment having a front portion that can be closed by a door. The door is configured to pivot at a bottom section thereof around a horizontally running axis. An illuminating device is configured to illuminate at least one of the cleaning compartment and the front portion of the cleaning compartment. A control device switches the illuminating device on or off based on a opening position of the door. The control device includes a switching element that is actuated by a Bowden cable arranged on the door in order to compensate for the weight of the door.

7 Claims, 5 Drawing Sheets

Fig. 3a(1)
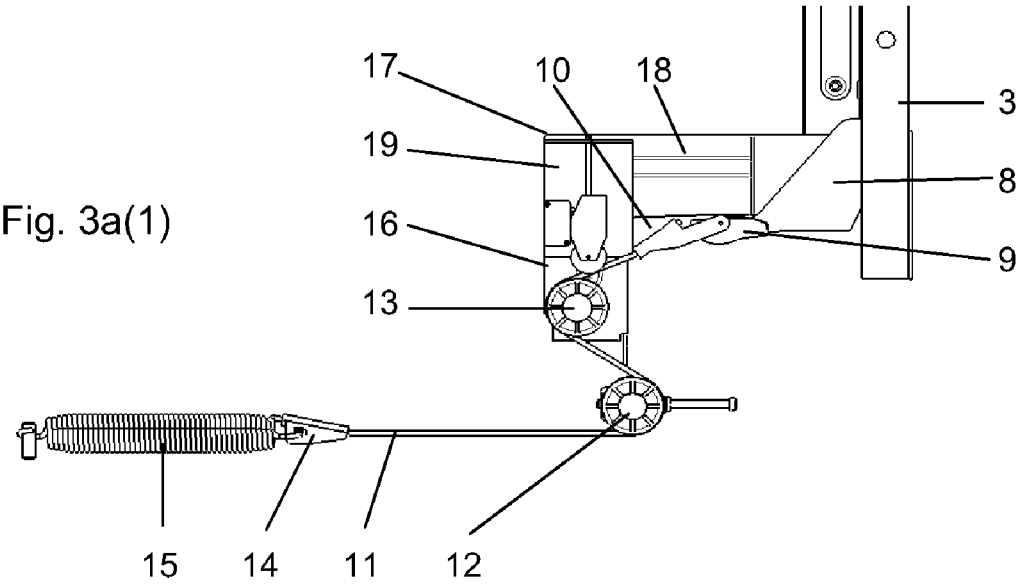
Fig. 3a(2)
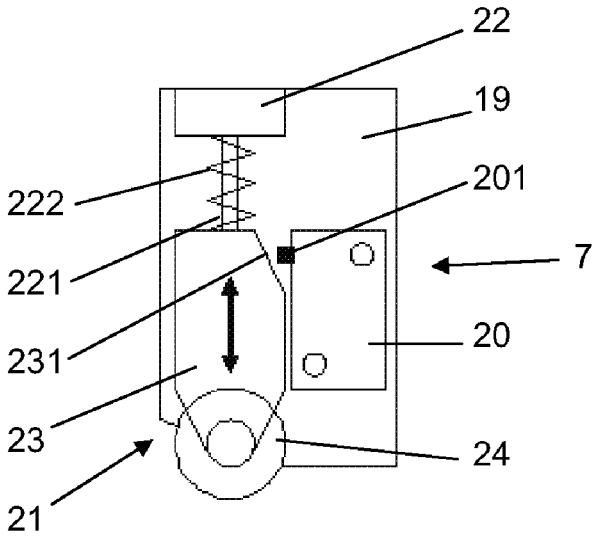

Fig. 3b(1)
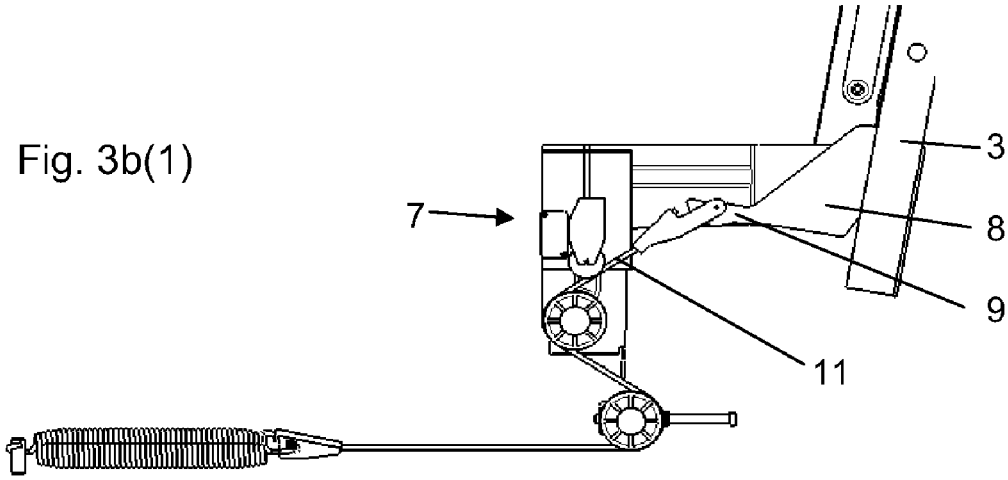
Fig. 3b(2)
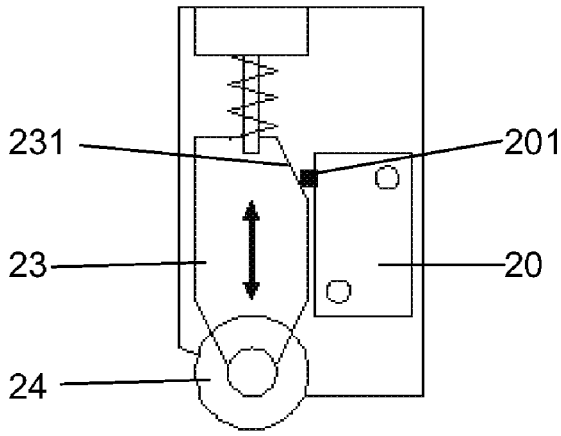

Fig. 3c(1)
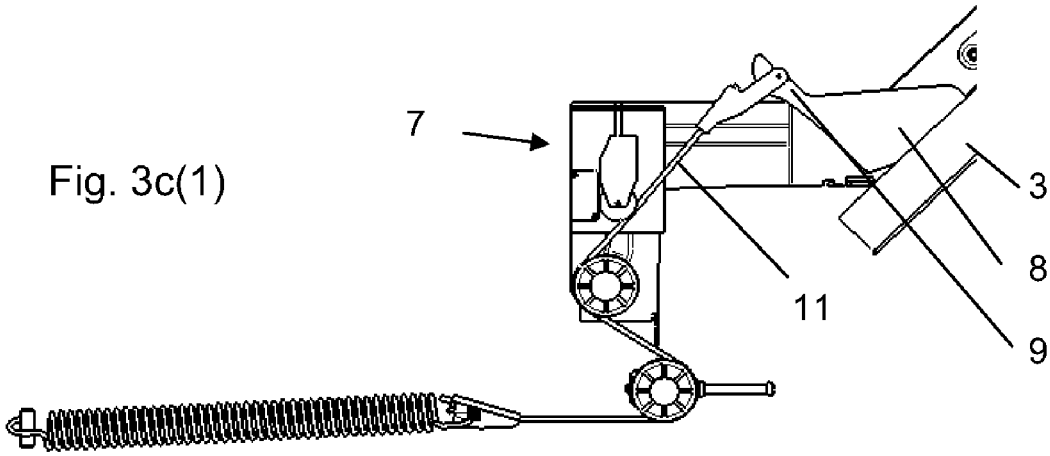
Fig. 3c(2)
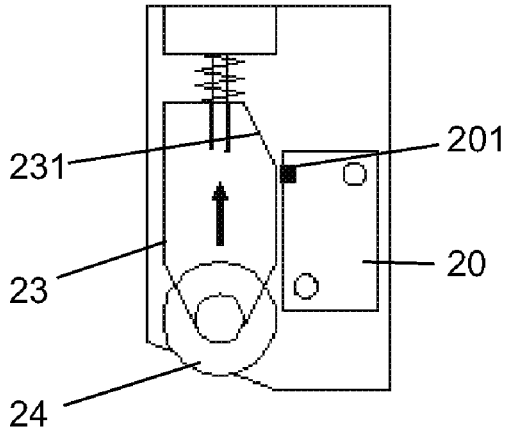

Fig. 3d(1)
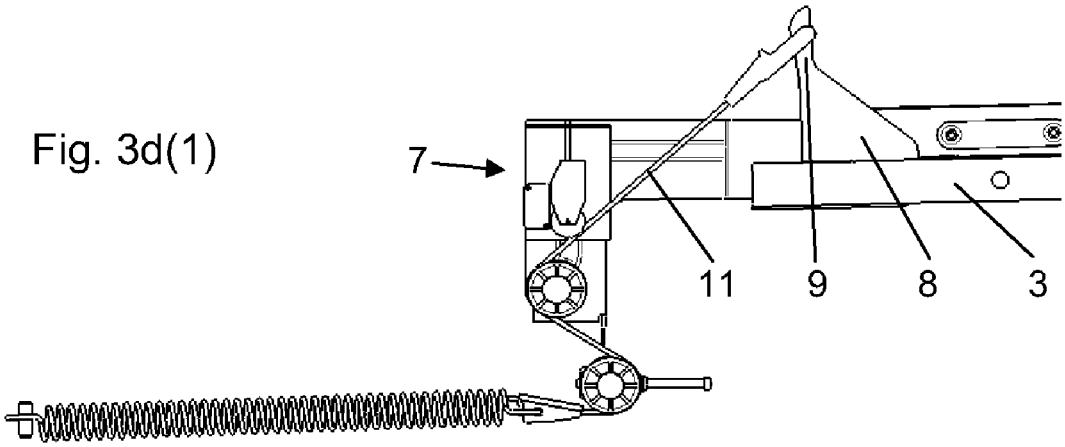
Fig. 3d(2)
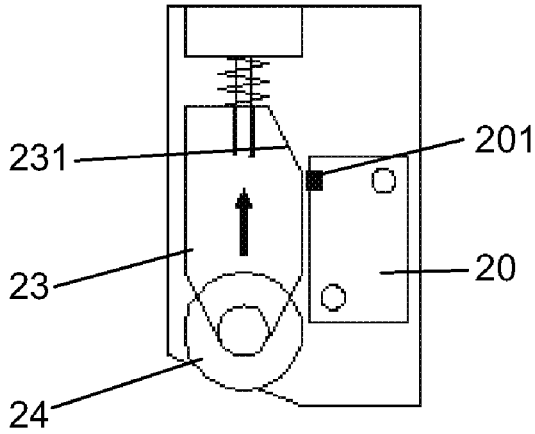

DISHWASHER WITH A LIGHTING DEVICE OF THE WASHING COMPARTMENT

CROSS-REFERENCE TO PRIOR APPLICATIONS

This application claims benefit to German Patent Application No. DE 10 2009 014 023.9, filed on Mar. 23, 2009, which is hereby incorporated by reference herein.

FIELD

The invention relates to a dishwasher with a cleaning compartment whose front can be closed by a door that can pivot at its bottom section around a horizontally running axis, with a device for illuminating the cleaning compartment and/or the front portion of the cleaning compartment, and with a control device for switching the illuminating device on and/or off as a function of the closing position of the door.

BACKGROUND

Certain dishwashers with a device for illuminating the cleaning compartment and/or the front portion of the cleaning compartment are well known from the state of the art. This measure is intended to make it easier to load and unload dishes. In order to lower energy consumption, it is a known procedure for the illuminating device to only switch on when the door is open. For this purpose, the control devices used comprise microswitches that are actuated by the door. Moreover, approximation switches such as, for example, Hall sensors, are known that are actuated when the metal door is almost closed. These switches have the drawback that they are only actuated by a completely or at least almost completely closed door. If the door of the dishwasher is open by a small gap, as is commonly done, for example, at the end of the cleaning program in order to assist the drying, then the illuminating device remains switched on for a long time. This results in increased energy consumption.

German patent application DE 10 2005 028 449 A1 describes a motor-driven closing piston for a door closing mechanism.

German patent application DE 10 2004 023 509 A1 describes attachment of a tension spring and of deflection rollers to the housing of a dishwasher.

German patent application DE 10 2005 028 449 A1 describes an automatic door opening device.

SUMMARY

In an embodiment, the present invention provides a dishwasher including a cleaning compartment having a front portion that can be closed by a door. The door is configured to pivot at a bottom section thereof around a horizontally running axis. An illuminating device configured to illuminate at least one of the cleaning compartment and the front portion of the cleaning compartment. A control device switches the illuminating device on or off based on the opening position of the door. The control device includes a switching element that is actuated by a Bowden cable arranged on the door in order to compensate for the weight of the door.

BRIEF DESCRIPTION OF THE DRAWINGS

An embodiment of the invention is shown purely schematically in the drawings and is described in greater detail below. In the drawings:

FIG. 3*a*(1) is a view illustrating the door. Bowden cable and switching element in position with the door closed;

FIG. 3*a*(2) is a detail view of the switching element in the position of FIG. 3*a*(1);

FIG. 3*b*(1) is a view illustrating the door, Bowden cable and switching element in another position;

FIG. 3*b*(2) is a detail view of the switching element in the position of FIG. 3*b*(1);

FIG. 3*c*(1) is a view illustrating the door, Bowden cable and switching element in yet another position;

FIG. 3*c*(2) is a detail view of the switching element in the position of FIG. 3*c*(1);

FIG. 3*d*(1) is a view illustrating the door cable and switching element in a position with the door open; and FIG. 3*d*(2) is a detail view of the switching element in the position of FIG. 3*d*(1).

DETAILED DESCRIPTION

In an embodiment, the present invention provides a dishwasher including a device for illuminating the cleaning compartment, in which the light remains switched off, also when the door is open by a small gap.

Advantages that can be achieved with the invention ensue from the fact that the control device comprises a switching element that is actuated by a Bowden cable arranged on the door in order to compensate for the weight of the door. As a result, on the one hand, already present structural elements can be used, and on the other hand, it is easy to achieve that the light is only switched on once a specific door opening angle has been reached.

In an advantageous embodiment, the Bowden cable is arranged on the door in such a way that its swiveling causes a swiveling motion of at least one section of the Bowden cable, said motion being sufficient to actuate the switching element. This causes an uncoupling of the Bowden cable and the switching element. Here, it is advantageous for the Bowden cable to act on a spring-mounted piston that, when it is depressed, triggers the activation of a microswitch.

Moreover, it is advantageous for the illuminating device to be switched on once the opening angle of the door is more than approximately 10°. In this manner, in order to initially assist the drying, a sufficient air exchange is possible through the door, which is open by a small gap, without the light being switched on.

Figure 1:
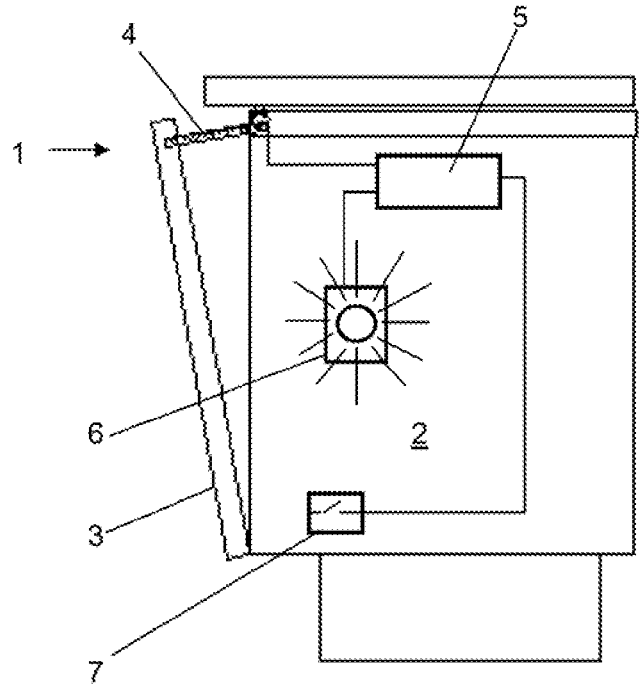
FIG. 1 is a dishwasher with cleaning compartment illumination.

FIG. 1 shows a dishwasher 1 with a cleaning compartment 2 whose front can be closed by a swiveling door 3. The door closing mechanism has a known motor-driven closing piston 4. that is only sketched in the figure. In this manner, the door 3 can also be automatically opened by a small gap by means of the program control 5, also in the locked state. Moreover, the dishwasher 1 has a lamp 6 for illuminating the cleaning compartment 2 and/or the front portion of the cleaning compartment. In order to allow the lamp 6 to be switched on and off as a function of the closing position of the door 3, a switching element 7 is provided whose structure and functions are explained below.

Figure 2:
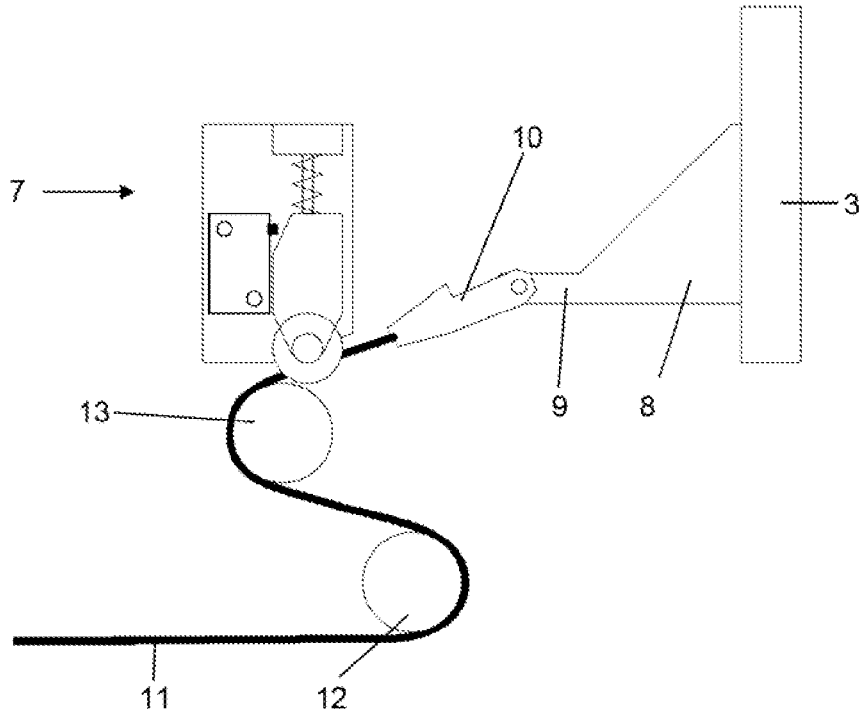
FIG. 2 is a view of the door of the dishwasher with a Bowden cable, deflection rollers and a switching element.

The lower end of the door 3 has an angled piece 8 with an arm 9 that projects perpendicularly out of the plane of the door and into the interior of the appliance. In a recess (not visible) located at the end of the arm 9, a Bowden cable 11 is secured by means of an eye 10. The Bowden cable 11 is deflected over two rollers 12 and 13, and its other end 14 is connected to a tension spring 15 (see FIGS. 3*a* to 3*d*). The entire device serves to compensate for the weight of the cladding (not shown here) that serves as a panel for the front of the door 3, matching it to the other cabinet doors in the kitchen. The attachment of the tension spring 15 and of the deflection rollers 12 and 13 to the housing of the dishwasher 1 may be in a known matter. In FIGS. 3*a* to 3*d*, it can merely be seen that the upper deflection roller 13 is mounted on the vertical leg 16 of a support 17 whose horizontal leg 18 serves to mount the door 3 so that it can swivel. Furthermore, a holding plate 19 is also attached to the leg 16, said holding plate 19 having a microswitch 20 and an actuator 21; also see FIG. 2. The actuator 21 comprises a stamp 22, a roller holder 23 and a pressure roller 24. The bolt-like end 221 of the stamp is surrounded by a spring 222 and is held by the roller holder 23 in such a way that it can be moved lengthwise. In this manner, the roller holder 23 can be moved against the force of the spring 222 in the direction indicated by the double-headed arrow. The side of the roller holder 23 facing the microswitch 20 has a switching cam 231 with which the switching tappet 201 of the microswitch can be actuated.

FIGS. 3*a* to 3*d* show the sequence of movements during the opening of the door 3. When the door 3 is closed (FIG. 3*a*), the arm 9 extends horizontally, i.e. parallel to the standing plane of the dishwasher 1 and, due to the deflection roller 13, the end of the Bowden cable 11 on the door side encloses an angle of approximately 30° relative to the imaginary parallel of the standing plane. The pressure roller 24 rests on the Bowden cable 11, at this time, the roller 24 and the roller holder 23 are in a lower position in which the switching cam 231 is still at a distance from the switching tappet 201. FIG. 3*b* shows the door in a position in which it is open by about 10°. This opening angle can be established manually by the user or else automatically by an opening device. The arm 9 that also executes the swiveling motion of the door 3 pulls the Bowden cable 11 upwards, so that it is swiveled counterclockwise by about 15°. In this process, the Bowden cable 11 lifts the pressure roller 24 along with the roller holder 23 so that the switching cam 231 is moved until shortly before the switching tappet 201. Consequently, the cleaning compartment light (lamp 6) is not yet switched on in this position. When the door 3 (FIG. 3*c*) is opened further, the Bowden cable 11 is swiveled counterclockwise once again by 10°. As a result, the pressure roller 24 is raised even further and the switching cam 231 pushes the switching tappet 201 inwards. The microswitch 20 relays the triggered switching command to the program control 5, which now switches on the lamp 6. As an alternative, the lamp 6 can also be switched on directly by the microswitch 20. It can be seen in FIG. 3*d* that the switching tappet 201 is pressed inwards, also when the door 3 is completely open, and that the cleaning compartment light (lamp 6) thus remains switched on.

While the invention has been described with reference to particular embodiments thereof, it will be understood by those having ordinary skill in the art that various changes may be made therein without departing from the scope and spirit of the invention. Further, the present invention is not limited to the embodiments described herein; reference should be had to the appended claims.

The invention claimed is:

1. A dishwasher comprising:

a cleaning compartment having a front portion that can be closed by a door, the door being configured to pivot at a bottom section thereof around a horizontally running axis;

an illuminating device configured to illuminate at least one of the cleaning compartment and the front portion of the cleaning compartment;

a Bowden cable coupled to a housing of the dishwasher and the door, and configured to compensate for the weight of the door; and a control device for switching the illuminating device on or off based upon an opening position of the door, the control device including a switching element actuated by the Bowden cable.

2. The dishwasher according to claim 1, wherein the Bowden cable is disposed on the door such that a pivot of the door causes a swiveling motion of at least one section of the Bowden cable sufficient to actuate the switching element.

3. A dishwasher comprising:

a cleaning compartment having a front portion that can be closed by a door, the door being configured to pivot at a bottom section thereof around a horizontally running axis;

an illuminating device confused to illuminate at least one of the cleaning compartment and the front portion of the cleaning compartment; and a control device for switching the illuminating device on or off based upon opening position of the door, the control device including, a switching element actuated by a Bowden cable disposed on the door in order to compensate for the weight of the door, wherein the Bowden cable is coupled to a spring-mounted trigger device, the spring-mounted trigger device being configured to trigger a microswitch when depressed.

4. The dishwasher according to claim 2, wherein the Bowden cable is coupled to a spring-mounted trigger device, the spring-mounted trigger device being configured to trigger a microswitch when depressed.

5. The dishwasher according to claim 1, wherein the control device is configured to switch on the illuminating device on once the opening angle of the door is greater than approximately 10°.

6. The dishwasher according to claim 2, wherein the control device is configured to switch on the illuminating device once the opening angle of the door is greater than approximately 10°.

7. The dishwasher according to claim 3, wherein the control device is configured to switch on the illuminating device once the opening angle of the door is greater than approximately 10°.

* * * * *